US010443605B2

(12) United States Patent
Yagi et al.

(10) Patent No.: US 10,443,605 B2
(45) Date of Patent: Oct. 15, 2019

(54) IMPELLER, ROTARY MACHINE, AND IMPELLER MANUFACTURING METHOD

(71) Applicant: MITSUBISHI HEAVY INDUSTRIES COMPRESSOR CORPORATION, Tokyo (JP)

(72) Inventors: Nobuyori Yagi, Tokyo (JP); Satoru Yoshida, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 427 days.

(21) Appl. No.: 15/037,117

(22) PCT Filed: Nov. 17, 2014

(86) PCT No.: PCT/JP2014/080335
§ 371 (c)(1),
(2) Date: May 17, 2016

(87) PCT Pub. No.: WO2015/076217
PCT Pub. Date: May 28, 2015

(65) Prior Publication Data

US 2016/0290354 A1 Oct. 6, 2016

(30) Foreign Application Priority Data

Nov. 21, 2013 (JP) ..... 2013-240921

(51) Int. Cl.
*F04D 29/28* (2006.01)
*F04D 17/10* (2006.01)
(Continued)

(52) U.S. Cl.
CPC ..... *F04D 29/284* (2013.01); *F04D 17/10* (2013.01); *F04D 17/122* (2013.01);
(Continued)

(58) Field of Classification Search
CPC ..... F04D 29/20; F04D 29/263; F04D 29/266; F04D 29/284; F04D 29/624
See application file for complete search history.

(56) References Cited

U.S. PATENT DOCUMENTS 1,953,064 A * 4/1934 Dowson ..... F04D 29/284
416/186 R
1,983,201 A * 12/1934 Van Rijswijk ..... F04D 29/30
29/889.72

(Continued)

FOREIGN PATENT DOCUMENTS

CN 103097739 A 5/2013
CN 103237993 A 8/2013

(Continued)

OTHER PUBLICATIONS

International Search Report and Written Opinion of the International Searching Authority (Forms PCT/ISA/237 and PCT/ISA/210), dated Feb. 24, 2015, for International Application No. PCT/JP2014/080335, together with English translation thereof.

*Primary Examiner* — Jason D Shanske
*Assistant Examiner* — Brian O Peters
(74) *Attorney, Agent, or Firm* — Birch, Stewart, Kolasch & Birch, LLP

(57) ABSTRACT

This impeller is equipped with: a disk section that is fixed to a rotary shaft at least at the side of a first end in a direction of the axis and extends outward in a radial direction from the side of a second end; blade sections that are disposed to protrude from the disk section toward the side of the first end; and a cover section that covers the blade sections. The disk section includes a first member and a second member that are divided from each other in the direction of the axis by a dividing plane, which is orthogonal to the axis, at an
(Continued)

inner side in the radial direction relative to the blade sections. The first member and the second member are joined on the dividing plane.

2 Claims, 7 Drawing Sheets

(51) Int. Cl.
*F04D 17/12* (2006.01)
*F04D 29/26* (2006.01)
*F04D 29/62* (2006.01)

(52) U.S. Cl.
CPC ..... *F04D 29/266* (2013.01); *F04D 29/624* (2013.01); *F05D 2230/237* (2013.01); *F05D 2230/239* (2013.01)

(56) References Cited

U.S. PATENT DOCUMENTS 2,392,858 A * 1/1946 McMahan ..... F04D 29/284 416/186 R
2,936,715 A * 5/1960 Southam ..... F04D 29/146 277/347
5,167,678 A * 12/1992 Elonen ..... F04D 9/003 415/169.1
6,862,183 B2 * 3/2005 Chrysler ..... F28F 3/02 165/185
2013/0251531 A1 9/2013 Yagi et al.
2014/0050585 A1 2/2014 Kawanishi et al.

FOREIGN PATENT DOCUMENTS

JP 2001-355595 A 12/2001
JP 2004-92650 A 3/2004
JP 2004-308647 A 11/2004
JP 2008-121650 A 5/2008
JP 2009-156122 A 7/2009
JP 2012-122398 A 6/2012
JP 2012-172645 A 9/2012
JP 2012-233410 A 11/2012
JP 2013-47479 A 3/2013
JP 2013-133735 A 7/2013
JP 2013-139753 A 7/2013

* cited by examiner

IMPELLER, ROTARY MACHINE, AND IMPELLER MANUFACTURING METHOD

TECHNICAL FIELD

The present invention relates to an impeller, a rotary machine, and an impeller manufacturing method.

Priority is claimed on Japanese Patent Application No. 2013-240921, filed on Nov. 21, 2013, the content of which is incorporated herein by reference.

BACKGROUND ART

Rotary machines used in, for instance, industrial compressors, turbo refrigerators, small gas turbines, etc. are equipped with an impeller in which a plurality of blades are mounted on a disk fixed to a rotary shaft. These rotary machines rotate the impeller to give pressure energy and kinematic energy to a gas.

As the above impeller, a so-called closed impeller in which a cover is integrally mounted on the blades is known. This closed impeller may have a structure in which a plurality of parts are joined and assembled. When the impeller has this joined structure, there is a tendency for quality of shape in flow passages and performance of the impeller to decrease. For this reason, the impeller is made in one piece. However, when the impeller is made in one piece, complicated cutting and welding are required, and it takes time to assemble the impeller.

In Patent Literature 1, a technology in which a first member in which a disk section, a blade section, and a cover section that form flow passages are made in one piece and a second member located at one side of the disk section in an axial direction are separately formed, and thereby accessibility of machining tools to the first member can be improved is proposed.

CITATION LIST

Patent Literature

[Patent Literature 1]

Japanese Unexamined Patent Application, First Publication No. 2013-47479

SUMMARY OF INVENTION

Technical Problem

The aforementioned impeller may be mounted on the rotary shaft using thermal deformation. When the impeller is mounted on the rotary shaft using the thermal deformation in this way, if the disk section is divided into the first and second members, the first and second members should be individually mounted on or dismounted from the rotary shaft. Thus, there is a problem that in the task of mounting on and dismounting from the rotary shaft is complicated. For example, when the first member is mounted on the rotary shaft by the thermal deformation and then the second member is mounted on the rotary shaft by the thermal deformation, there is a possibility of heat of the second member being transmitted to the first member and a position of the first member being shifted.

The present invention provides: an impeller capable of improving quality of shape in flow passages and that can easily be mounted on and dismounted from a rotary shaft; a rotary machine; and an impeller manufacturing method.

Solution to Problem

According to a first aspect of the present invention, an impeller includes: a disk section having at least a first end side which is fixed to a rotary shaft which rotates about an axis, and extending outward in a radial direction to a second end side which opposite to the first end side in the direction of the axis from the first end side; blade sections provided to protrude from the disk section to the first end side in the direction of the axis; and a cover section integrally provided for the blade sections and configured to cover the blade sections from the first end side in the direction of the axis. The disk section includes a first member and a second member that are divided from each other in the direction of the axis by a dividing plane which is orthogonal to the axis, at inner sides of the blade sections in the radial direction. The first member and the second member are joined on the dividing plane.

With this constitution, the second member can be machined in a state in which no member is disposed at the inner sides of the blade sections in the radial direction. Also, since the first member and the second member are joined on the dividing plane, it is unnecessary to individually mount the first member and the second member on the rotary shaft. In addition, when the first member is mounted on the rotary shaft using thermal deformation, at least the first end side in the direction of the axis is fixed to the rotary shaft, and thus a temperature can be raised faster than when the second end side that extends outward in the radial direction and has a large cross-sectional area is fixed. Further, since the dividing plane is orthogonal to the axis, welding work can be easily performed, compared to a case in which the dividing plane is oblique.

According to a second aspect of the present invention, in the impeller, the dividing plane may have a step section which regulates the second member from being displaced toward an outer circumferential side in the radial direction with respect to the first member.

With this constitution, the second member can be easily positioned for the first member. Also, since displacement of the second member toward the outside in the radial direction is regulated by the step section, a force acting on the dividing plane in a shearing direction can be suppressed. For this reason, it is possible to improve the joining strength. For example, it is also possible to suppress the deformation of the second member having larger mass than the first member toward the outside in the radial direction.

According to a third aspect of the present invention, the dividing plane of the impeller may be joined by brazing or friction stir welding.

With this constitution, the first member can be easily joined to the second member.

According to a fourth aspect of the present invention, a rotary machine includes the above impeller.

With this constitution, it is possible to easily perform maintenance of the impeller and to suppress a variation in quality to improve merchantability.

According to a fourth aspect of the present invention, an impeller manufacturing method in which an impeller includes: a disk section fixed to a rotary shaft, which rotates about an axis, at least at a first end side in a direction of the axis and configured to extend outward in a radial direction from a second end side opposite to the first end side in the direction of the axis; blade sections provided to protrude from the disk section to the first end side in the direction of the axis; and a cover section integrally provided for the blade sections and configured to cover the blade sections from the first end side in the direction of the axis, wherein the disk section includes a first member and a second member that are divided from each other in the direction of the axis by a dividing plane, which is orthogonal to the axis, at inner sides of the blade sections in the radial direction. The impeller manufacturing method includes: a process of forming the first member; a process of forming the second member in which the blade sections, the cover section, and the disk section are integrally formed; a process of joining the first member and the second member; and a process of at least fixing the first member to the rotary shaft.

With this constitution, machinability of flow passages defined by the disk section, the blade sections, and the cover section can be improved. Also, after the first member and the second member are joined, the first member can be fixed to the rotary shaft, and thus be easily mounted on and dismounted from the rotary shaft.

Advantageous Effects of Invention

According to the aforementioned impeller, rotary machine, and impeller manufacturing method, it is possible to improve quality of shape in flow passages and to easily perform mounting on and dismounting from the rotary shaft.

DESCRIPTION OF EMBODIMENTS (First Embodiment)

Next, a rotary machine in a first embodiment of this invention will be described with reference to the drawings.

Figure 1:
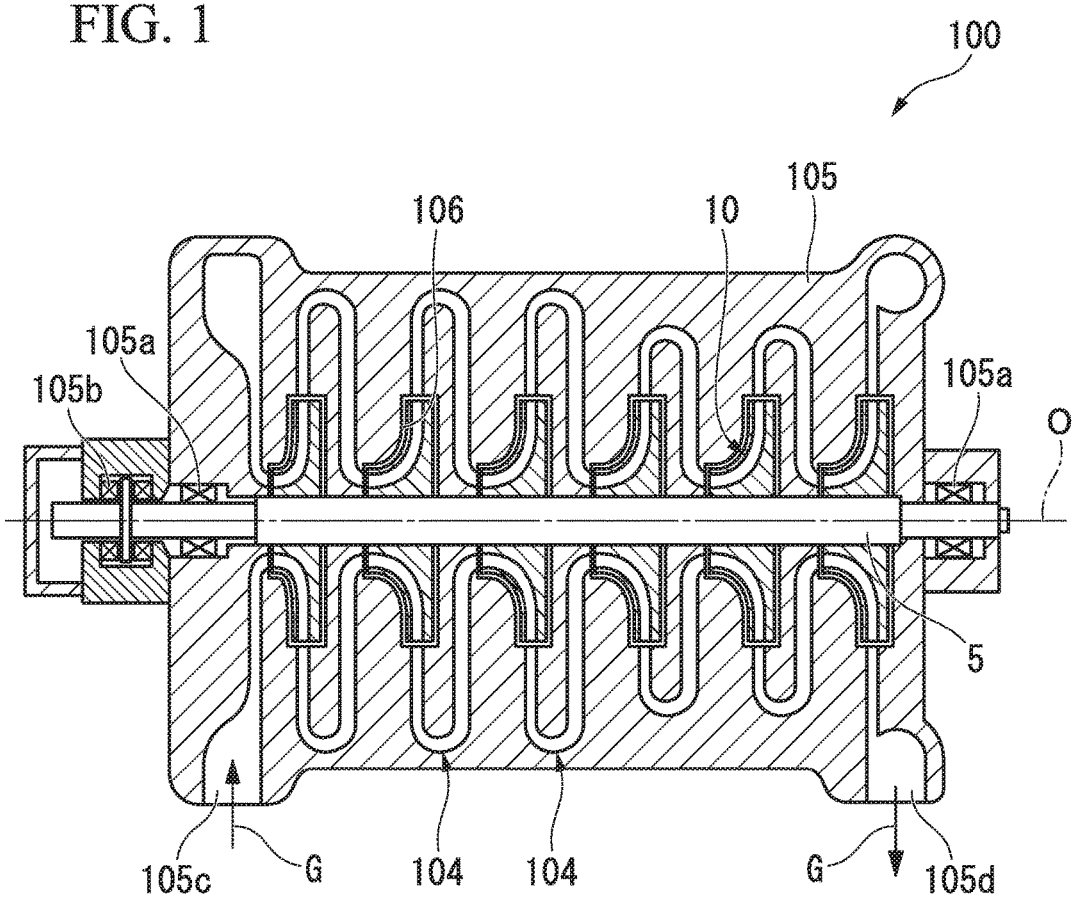
FIG. 1 is a sectional view of a centrifugal compressor in a first embodiment of this invention.
Figure 2:
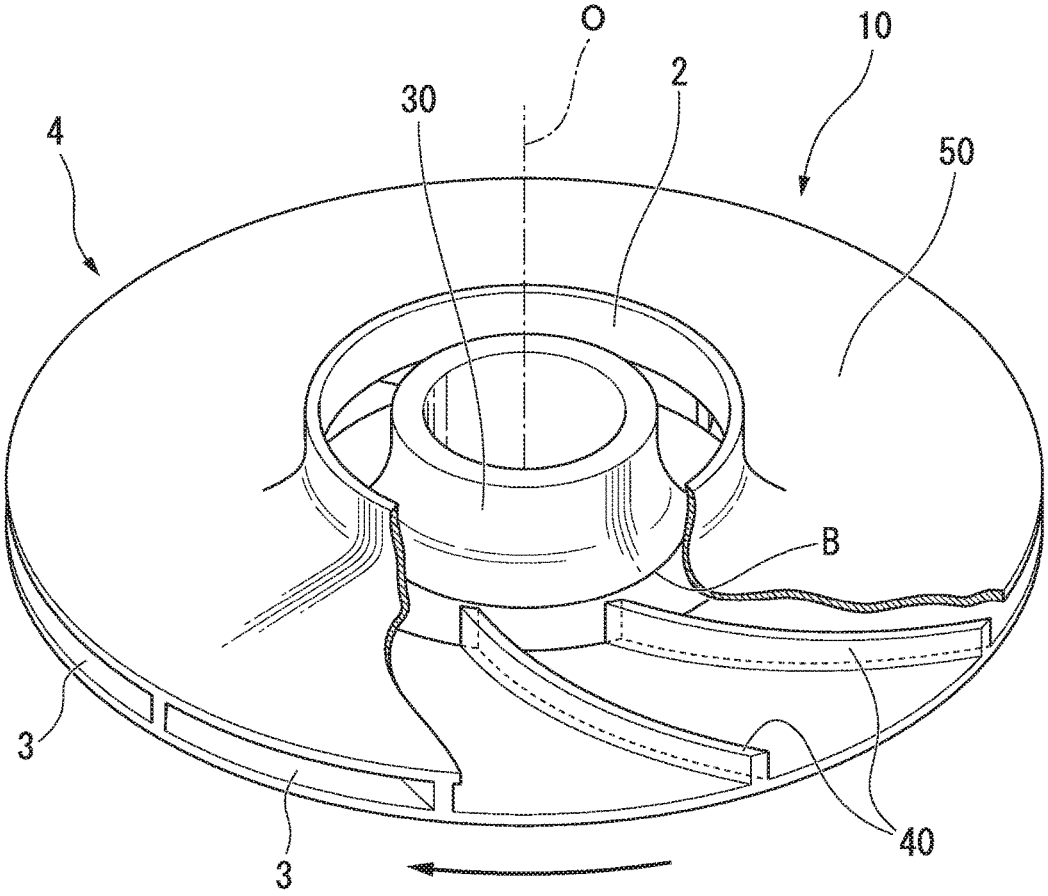
FIG. 2 is a perspective view of an impeller in a first embodiment of this invention.
Figure 3:
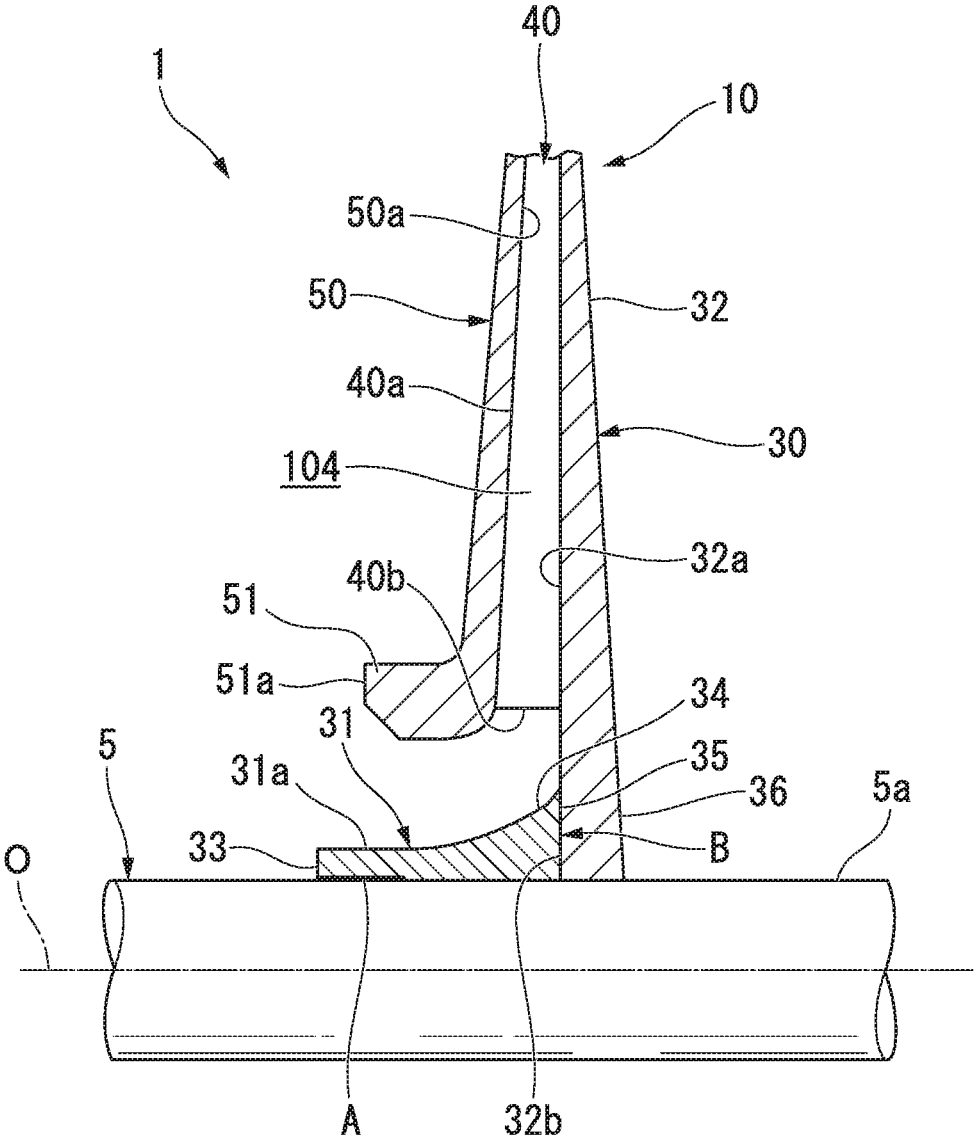
FIG. 3 is a sectional view of the impeller in the first embodiment of this invention.

FIG. 1 is a sectional view showing a schematic constitution of a centrifugal compressor 100 equipped with the rotary machine of this embodiment. FIG. 2 is a perspective view of an impeller in a first embodiment of this invention. FIG. 3 is a sectional view of the impeller in the first embodiment of this invention.

As shown in FIG. 1, a rotary shaft 5 is supported on a casing 105 of the centrifugal compressor 100 via journal bearings 105*a* and a thrust bearing 105*b*. The rotary shaft 5 can be rotated about an axis O. A plurality of impellers 10 are mounted on this rotary shaft 5 in parallel in a direction of the axis O.

As shown in FIG. 2, each of the impellers 10 has approximately a disk shape. Each of the impellers 10 is configured to discharge a fluid suctioned from an inlet 2 opened at one side thereof in the direction of the axis O toward an outer circumferential side in a radial direction via flow passages 104 formed inside the impeller 10.

Each of the impellers 10 gradually compresses a gas G supplied from an upstream flow passage 104 formed in the casing 105 using a centrifugal force caused by rotation of the rotary shaft 5, and discharges the compressed gas G to a downstream flow passage 104.

As shown in FIG. 1, the casing 105 is formed with a suction port 105*c* for causing the gas G to flow in from the outside at a front side (a left side in FIG. 1) of the rotary shaft 5 in the direction of the axis O. The casing 105 is also formed with a discharge port 105*d* for causing the gas G to flow out to the outside at a rear side (a right side in FIG. 1) in the direction of the axis O. In the following description, the left side of the page is referred to as "front side," and the right side of the page is referred to as "rear side."

According to the above centrifugal compressor 100, if the rotary shaft 5 is rotated, the gas G flows from the suction port 105*c* into the flow passage 104. This gas G is compressed by the impellers 10 in a step-by-step manner, and is discharged from the discharge port 105*d*. In FIG. 1, an example in which six impellers 10 are provided for the rotary shaft 5 in series is shown, but at least one impeller 10 may be provided for the rotary shaft 5. In the following description, to simplify the description, a case in which only one impeller 10 is provided for the rotary shaft 5 will be described by way of example.

As shown in FIGS. 2 and 3, the impeller 10 is equipped with a disk section 30, blade sections 40, and a cover section 50.

The disk section 30 is fitted from the outside in the radial direction, and thereby is mounted on the rotary shaft 5. The disk section 30 is provided with a first member 31 and a second member 32 that are axially divided from each other by a dividing plane B orthogonal to the axis O. These first and second members 31 and 32 are joined on the dividing plane B.

The first member 31 has an approximately cylindrical shape whose center is the axis O. The first member 31 is provided with a grip section A fitted around the rotary shaft 5 at the side of a first end 33 thereof at the front side in the direction of the axis O. The first member 31 is also provided with an enlarged diameter section 34 whose diameter is gradually enlarged toward the rear side in the direction of the axis O. An outer circumferential surface of the enlarged diameter section 34 becomes a curved surface recessed toward the outside in a cross section including the axis O. Also, an end face 35 of the first member 31 at the rear side in the direction of the axis O is joined to the second member 32. Here, a method of fitting the first member 31 around the rotary shaft 5 at the above grip section A is a method of using thermal deformation, and for instance, cold-fitting or shrink-fitting may be used. In this embodiment, the impeller 10 is mounted on the rotary shaft 5 by the grip section A only. The second member 32 is formed in a disk shape that extends from the side of a second end 36, which is opposite to the side of the first end 33 in the direction of the axis O, toward the outside in the radial direction. A base-section-side region 32*b* of a front side surface 32*a* of the second member 32 is joined with the end face 35 of the first member 31. The end face 35 and the base-section-side region 32*b* of the front side surface 32*a* constitute the dividing plane B orthogonal to the axis O. Here, to be orthogonal to the axis O refers to extending in a radial direction of the disk section 30.

The first member 31 and the second member 32 are joined on the dividing plane B by brazing or friction stir welding (FSW).

The plurality of blade sections 40 are arranged in a circumferential direction of the disk section 30 at predetermined intervals.

The blade sections 40 are formed with a nearly constant strip thickness, and are formed to protrude from the front side surface 32*a* of the disk section 30 toward the front side in the direction of the axis O. Also, as shown in FIG. 3, the blade sections 40 are formed to be slightly tapered toward the outside in the radial direction in a side view.

As shown in FIG. 2, when viewed in the direction of the axis O, each of the blade sections 40 is formed to face a rear side in a rotating direction of the impeller 10 toward the outside of the disk section 30 in the radial direction. Also, when viewed in the direction of the axis O, each of the blade sections 40 is formed to be bent in a concave shape recessed toward a rear side in a rotating direction of the axis. Here, one example in which the blade sections 40 are formed to be bent when viewed in the direction of the axis O is described, but the blade sections 40 may extend to the rear side in the rotating direction toward the outside in the radial direction. For example, when viewed in the direction of the axis O, the blade sections 40 may be linearly formed.

In FIG. 2, the rotating direction of the impeller 10 is indicated by an arrow.

The cover section 50 covers the blade sections 40 from the side of the first end 33 in the direction of the axis O. A rear side surface 50*a* of the cover section 50 in the direction of the axis O is integrally mounted on front side edges 40*a* of the blade sections 40. Similar to the thickness of the disk section 30, the thickness of the cover section 50 is formed in a sheet shape in which the thickness toward the outward in the radial direction is slightly thin. This cover section 50 has a flexure section 51, which is bent toward the front side in the direction of the axis O, at positions of inner ends 40*b* of the blade sections 40.

In the impeller 10 configured as described above, the enlarged diameter section 34 and the dividing plane B are disposed at inner sides of the blade sections 40 in the radial direction. Also, the first end 33 of the first member 31 is disposed at the front side in the direction of the axis O relative to a front side edge 51*a* of the flexure section 51. The flow passages 104 along which the gas G flows are defined by an outer circumferential surface 31*a* of the first member 31, the front side surface 32*a* of the second member 32, lateral surfaces 40*c* of the blade sections 40, and a rear side surface 50*a* of the cover section 50.

Figure 4:
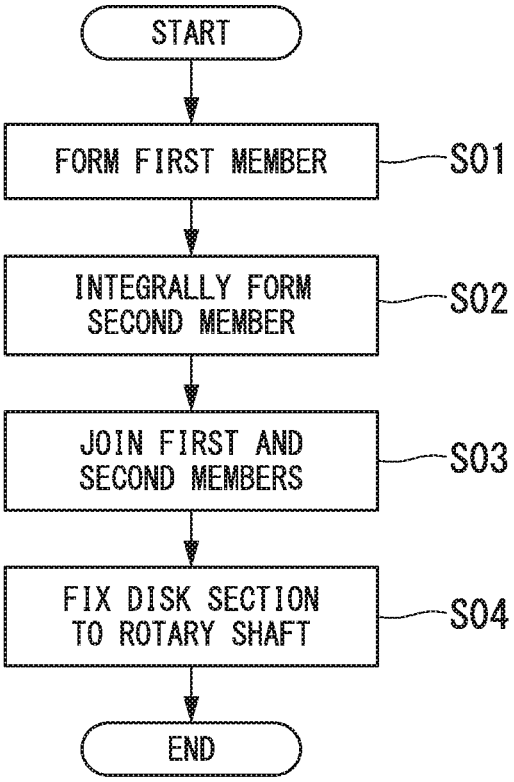
FIG. 4 is a flow chart showing an impeller manufacturing method in a first embodiment of this invention.

Next, a method of manufacturing the aforementioned impeller 10 will be described with reference to a flow chart of FIG. 4.

First, the first member 31 is formed by casting or cutting (step S01).

Next, the second member 32 is formed integrally with the blade sections 40 and the cover section 50 (step S02). To be more specific, the second member 32, the blade sections 40, and the cover section 50 are integrally formed by cutting one base material such as precipitation hardening stainless steel.

Also, the first member 31 and the second member 32 are joined at the dividing plane B (step S03). To be more specific, the base-section-side region 32*b* of the front side surface 32*a* of the second member 32 and the end face 35 of the first member 31 are joined by brazing or FSW.

Afterwards, the grip section A of the first member 31 is fitted at a predetermined position of the outer circumferential surface 5*a* of the rotary shaft 5 by shrink-fitting (step S04).

Therefore, according to the impeller 10 of the aforementioned first embodiment, the second member 32 can be machined in a state in which no member is disposed at an inner side in the radial direction relative to the blade sections 40. Also, since the first member 31 and the second member 32 are joined on the dividing plane B, it is unnecessary to individually mount the first member 31 and the second member 32 on the rotary shaft 5. In addition, when the first member is mounted on the rotary shaft 5 using the thermal deformation, the grip section A at the side of the first end 33 in the direction of the axis O is fixed to the rotary shaft 5, and thus a temperature can be raised faster than when the side of the second end 36 that extends outward in the radial direction and has a large cross-sectional area is fixed. Further, since the dividing plane B is orthogonal to the axis O, welding work can be easily performed, compared to a case in which the dividing plane B is oblique.

As a result, quality of shape in the flow passages 104 can be improved, and the first member can be easily mounted on and dismounted from the rotary shaft 5.

Also, according to the centrifugal compressor 100 of the aforementioned first embodiment, it is possible to easily perform maintenance of the impeller 10 and to suppress a variation in quality to improve merchantability.

Further, the dividing plane B of the impeller 10 is joined by the brazing or the FS W. For this reason, the first member 31 can be easily welded to the second member 32.

Also, according to the method of manufacturing the impeller 10 of the aforementioned first embodiment, machinability of the flow passages 104 defined by the disk section 30, the blade sections 40, and the cover section 50 can be improved. In addition, after the first member 31 and the second member 32 are joined, the first member 31 can be fixed to the rotary shaft 5 and thus be easily mounted on and dismounted from the rotary shaft 5.

Further, when the first member 31 and the second member 32 are brazed, the first member 31 and the second member 32 are heated to about 900° C. Also, when the first member 31 is joined to the rotary shaft 5 by the shrink-fitting, the first member 31 and the second member 32 are heated to about 500° C. that is lower than the temperature of the brazing. For this reason, the first member 31 and the second member 32 are brazed and then shrink-fitted, and thereby assembly can be smoothly performed by the heating caused by the shrink-fitting without exerting an adverse influence on the joined portion between the first member 31 and the second member 32.

(Second Embodiment)

Next, an impeller in a second embodiment of this invention will be described on the basis of the drawings. The impeller of the second embodiment is different from the impeller 10 of the aforementioned first embodiment only in that a step section is formed on the dividing plane B. For this reason, the same portions as in the aforementioned first embodiment will be given the same reference signs and be described, and duplicate descriptions will be omitted.

Figure 5:
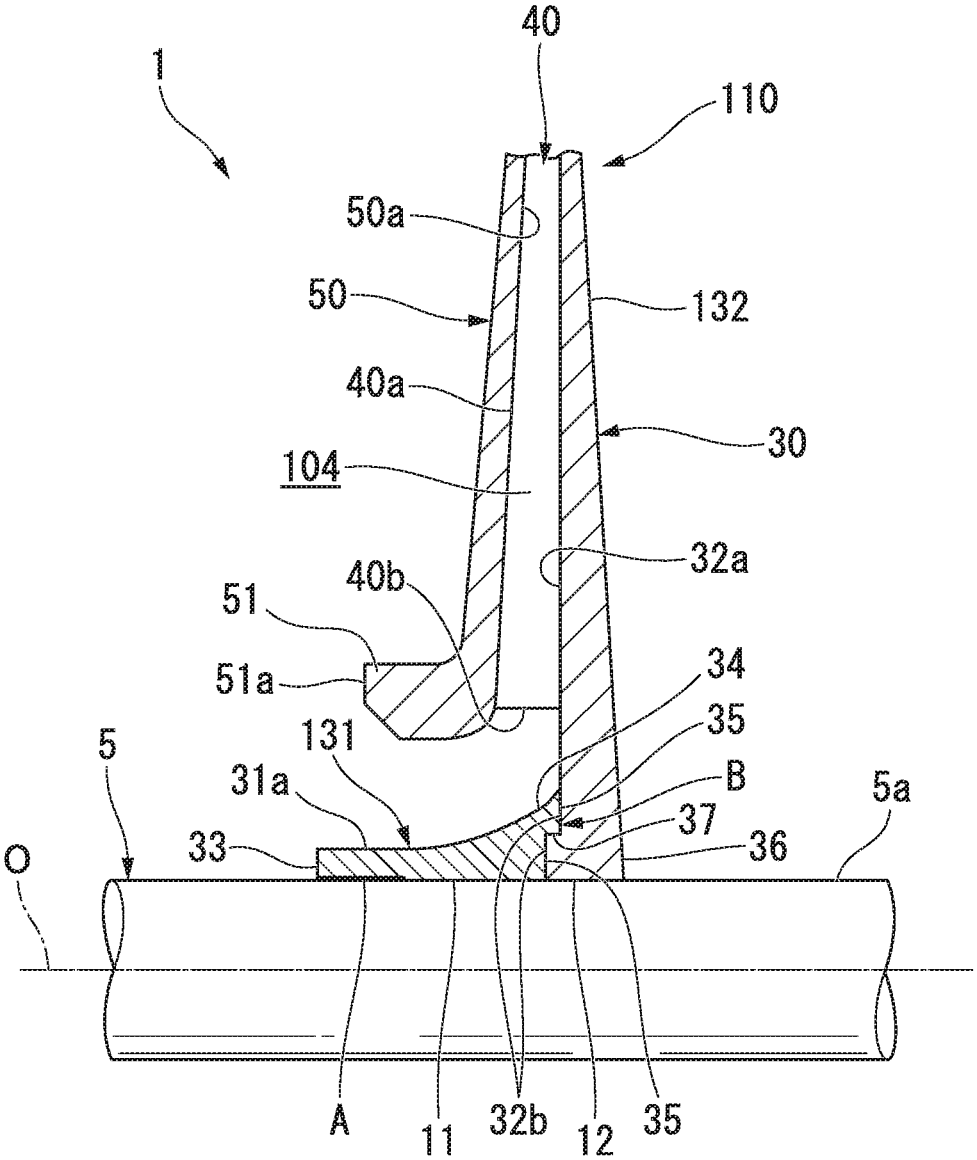
FIG. 5 is a sectional view equivalent to FIG. 3 in a second embodiment of this invention.

FIG. 5 is a sectional view equivalent to FIG. 3 in the second embodiment of this invention.

As shown in FIG. 5, the impeller 110 in the second embodiment is equipped with a disk section 30, blade sections 40, and a cover section 50. A detailed description of the blade sections 40 and the cover section 50 will be omitted because they have the same constitutions as in the aforementioned first embodiment.

The disk section 30 is equipped with a first member 131 and the second member 132.

The first member 131 has an approximately cylindrical shape whose center is an axis O. The first member 131 is provided with a grip section A fitted around a rotary shaft 5 at the side of a first end 33 thereof at a front side in a direction of the axis O. The grip section A is fitted around the rotary shaft 5 from the outside by a method using thermal deformation. Like the first embodiment, for instance, cold-fitting or shrink-fitting may be used as this fitting method.

The first member 131 is provided with an enlarged diameter section 34 whose diameter is gradually enlarged toward a rear side in the direction of the axis O.

An outer circumferential surface of the enlarged diameter section 34 becomes a curved surface recessed toward the outside in a cross section including the axis O. Also, an end face 35 of the first member 131 at the rear side in the direction of the axis O is joined to the second member 132.

The second member 132 is formed in a disk shape that extends outward in a radial direction from the side of a second end 36 thereof in the direction of the axis O. A base-section-side region 32*b* of a front side surface 32*a* of the second member 132 is joined with the end face 35 of the first member 131. The end face 35 and the base-section-side region 32*b* of the front side surface 32*a* constitute the dividing plane B that is orthogonal to the axis O and divides the disk section 30 into the two parts.

The disk section 30 has a step section 37 on the dividing plane B thereof. This step section 37 regulates the second member 132 from being displaced toward an outer circumferential side in the radial direction with respect to the first member 131. The step section 37 is formed in the dividing plane B in a radial direction, more particularly at a middle section of the dividing plane B in the radial direction.

Figure 6:
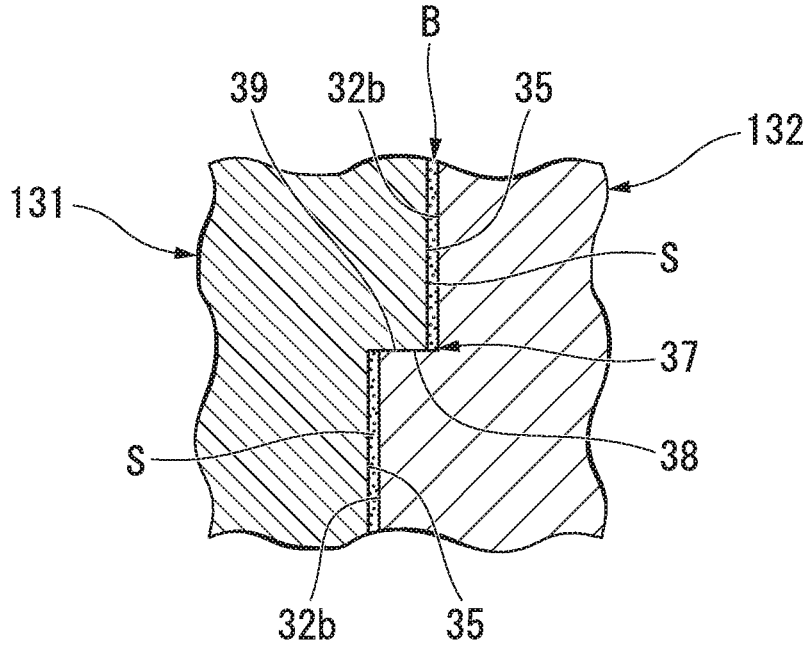
FIG. 6 is an enlarged view of a step section in the second embodiment of this invention.

FIG. 6 is an enlarged view of the step section 37 in the second embodiment of this invention.

As shown in FIG. 6, the step section 37 is provided with a backing face 38 and a mating face 39.

The backing face 38 is formed at the first member 131, and faces an inner side in the radial direction.

The mating face 39 is formed at the second member 132, and faces the outside in the radial direction.

The backing face 38 and the mating face 39 are formed around the rotary shaft 5 in an annular shape.

In other words, as shown in FIG. 5, the disk section 30 is formed with a concave groove in a circumferential edge of an opening at the side of the end face 35 of a through-hole 11 of the first member 131 into which the rotary shaft 5 is inserted. The disk section 30 is also formed with a convex portion that can be fitted into the concave groove in a circumferential edge of an opening at the side of the base-section-side region 32*b* of a through-hole 12 of the second member 132 into which the rotary shaft 5 is inserted.

As shown in FIG. 6, the end face 35 and the base-section-side region 32*b* of the front side surface 32*a* are joined on the dividing plane B. That is, the first member 131 and the second member 132 are joined only on a surface extending in a radial direction. In FIG. 6, a reference sign S indicates a joined portion. In the case of brazing, a brazing material is disposed at the joined portion S.

Therefore, according to the impeller 110 of the aforementioned second embodiment, the second member 132 can be easily positioned for the first member 131. Also, since displacement of the second member 132 toward the outside in the radial direction is regulated by the step section 37, a force acting on the dividing plane B in a shearing direction can be limited. For this reason, it is possible to improve the joining strength. For example, it is also possible to suppress deformation of the second member 132 having larger mass than the first member 131 toward the outside in the radial direction due to a centrifugal force.

This invention is not limited to the constitution of each of the aforementioned embodiments, and can be changed in design without departing from the scope thereof.

In each of the aforementioned embodiments, the case in which the first member 31 or 131 and the second member 32 or 132 are joined by the brazing or the FSW has been described. Joining methods other than the brazing and the FSW may be used.

Also, the case in which the grip section A is provided only at the side of the first end 33 has been described. However, the grip section A may be at least provided at the side of the first end 33. For example, fitting may be used at another position of, for instance, the side of the second end 36 in combination.

Figure 7:
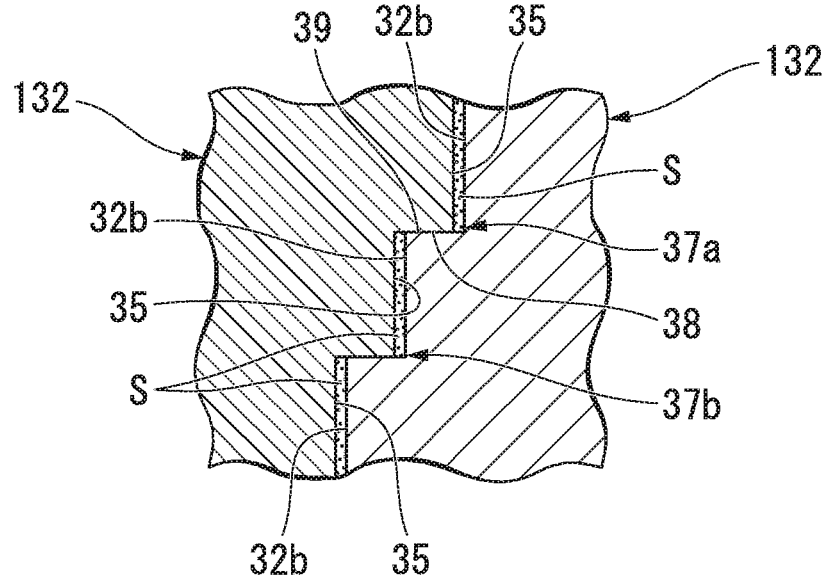
FIG. 7 is a sectional view equivalent to FIG. 6 in a modification of the second embodiment of this invention.

Further, in the aforementioned second embodiment, one example in which only the single step section 37 is formed has been described. However, the step section 37 is not limited to only the single step section. For example, as shown in FIG. 7, a plurality of step sections 37*a* and 37*b* may be configured to be provided. The number of step sections is not limited to two. Also, in the second embodiment, the case in which the brazing material is not disposed at the step section 37 has been described. However, the brazing material may also be configured to be disposed and brazed at the step section 37.

In each of the aforementioned second embodiments, the case in which the dividing plane B is disposed on an extension surface of the front side surface 32*a* of the second member 32 on which the blade sections 40 are mounted has been described, but the invention is not limited thereto. The dividing plane B may be disposed on the blade sections 40, more particularly at the inner sides of the inner ends 40*b* of the blade sections 40 in the radial direction, and extend in the direction orthogonal to the axis O.

Figure 8:
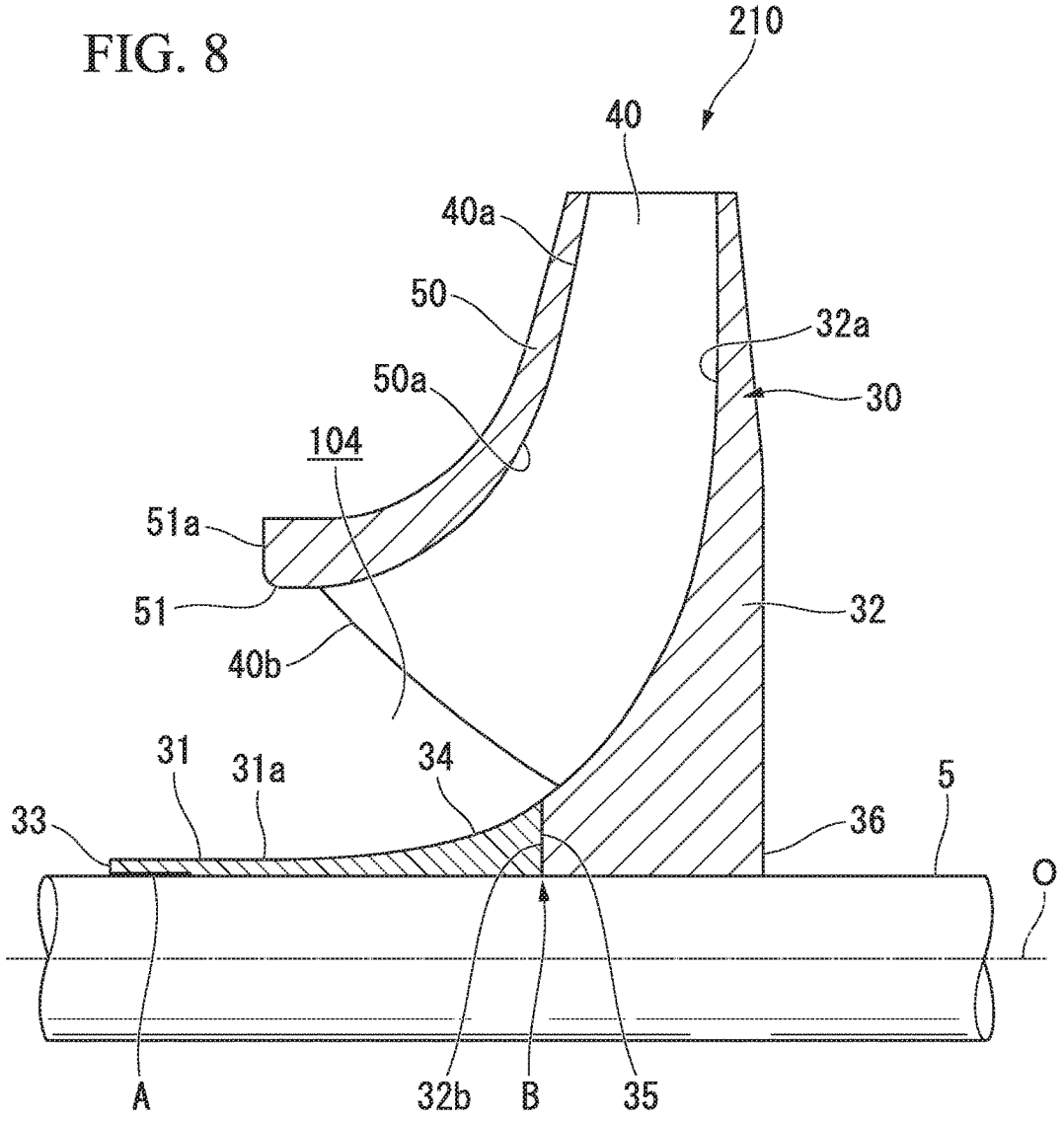
FIG. 8 is a sectional view equivalent to FIG. 6 in a modification of the first embodiment of this invention.

FIG. 8 shows an impeller 210 in a modification of the aforementioned first embodiment. Since this impeller 210 is merely different in shape from the impeller 10 of the aforementioned first embodiment, the same reference signs are given to the same portions. As shown in FIG. 8, for example, the dividing plane B may be disposed at the side of the first end 33 in the direction of the axis O relative to the position of the front side surface 32*a* on which the blade sections 40 are mounted within the front side surface 32*a*.

Further, in each of the aforementioned embodiments, the case in which the impeller 10 or 110 is applied to the centrifugal compressor 100 has been described. However, the rotary machine capable of applying the impeller 10 or 110 is not limited to the centrifugal compressor 100. The impeller 10 or 110 can also be applied to, for example, various industrial compressors or turbo refrigerators, or small gas turbines.

INDUSTRIAL APPLICABILITY

According to the impeller, the rotary machine, and the impeller manufacturing method, it is possible to improve quality of shape in the flow passages and easily perform mounting on and dismounting from the rotary shaft.

REFERENCE SIGNS LIST

5: Rotary shaft

5*a*: Outer circumferential surface

10: Impeller
11: Through-hole
30: Disk section
31: First member
31*a*: Outer circumferential surface
32: Second member
32*a*: Front side surface
32*b*: Base section-side region
33: First end
34: Enlarged diameter section
35: End face
36: Second end
37: Step section
38: Backing face
39: Mating face
40: Blade section
40*a*: Front side edge
40*b*: Inner end
40*c*: Lateral surface
50: Cover section
50*a*: Rear side surface
51: Flexure section
51*a*: Front side edge
100: Centrifugal compressor
104: Flow passage
105: Casing
105*a*: Journal bearing
105*b*: Thrust bearing
105*c*: Suction port
105*d*: Discharge port
A: Grip section
B: Dividing plane
G: Gas
O: Axis

The invention claimed is:

1. An impeller comprising:

a disk section fixed to a rotary shaft, which rotates about an axis, at least at a first end side in a direction of the axis and configured to extend outward in a radial direction from the first end side in the direction of the axis to a second end side opposite the first end side;

blade sections provided to protrude from the disk section to the first end side in the direction of the axis; and a cover section integrally provided for the blade sections and configured to cover the blade sections from the first end side in the direction of the axis;

wherein the disk section includes a first member and a second member that are divided from each other in the direction of the axis by a dividing plane, which is orthogonal to the axis, at inner sides of the blade sections in the radial direction; and wherein the first member and the second member are joined on the dividing plane, wherein the first member has a plurality of concave step sections and the first member is configured to be joined in contact with the rotary shaft at only a grip section which is provided at a front side of the first end side, wherein the dividing plane has a has a plurality of step sections each having a concave groove which is formed at the first member and has a convex portion which is formed at the second member and is capable of being fitted into the concave groove, wherein the first member and the second member are joined on only a surface extending in the radial direction of the dividing plane, wherein the concave groove has a backing face which faces the inner side in the radial direction and is a first horizontal plane, wherein the convex portion has a mating face which faces the outside in the radial direction and is a second horizontal plane, wherein the backing face is connected to a side of an end face of a through-hole of the first member into which the rotary shaft is inserted, so as to be formed in the dividing plane in the radial direction, and wherein the mating face is connected to a base-section-side region of a front side surface which is a side of the end face of a through-hole of the second member into which the rotary shaft is inserted, so as to be formed in the dividing plane in the radial direction.

2. A rotary machine comprising the impeller according to claim 1.

* * * * *